US006247828B1

(12) United States Patent
Herst

(10) Patent No.: US 6,247,828 B1
(45) Date of Patent: Jun. 19, 2001

(54) UNITARY EXTRUDED HOUSING FOR DIRECT-INDIRECT LUMINAIRE

(75) Inventor: Douglas J. Herst, Ross, CA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 08/400,325

(22) Filed: Mar. 9, 1995

(51) Int. Cl.[7] ..... F21S 3/00

(52) U.S. Cl. ..... 362/217; 362/225; 362/290; 362/362; 362/354

(58) Field of Search ..... 362/217, 223, 362/221, 222, 224, 225, 240, 290, 292, 354

(56) References Cited

U.S. PATENT DOCUMENTS

Re. 33,471 * 12/1990 Herst ..... 362/223
2,824,216 * 2/1958 Brennan ..... 362/354 X
2,874,271 * 2/1959 Lipscomb ..... 362/223
2,951,611 * 9/1960 Tillson et al. ..... 362/223 X
3,334,542 * 8/1967 Wenthe et al. ..... 362/290 X
4,625,267 * 11/1986 Mikalonis ..... 362/224 X
4,698,733 * 10/1987 Griffin ..... 362/260
4,866,581 * 9/1989 Targetti ..... 362/249
5,207,504 * 5/1993 Swift et al. ..... 362/217 X

* cited by examiner

*Primary Examiner*—Thomas M Sember
(74) *Attorney, Agent, or Firm*—Donald L. Beeson

(57) ABSTRACT

A housing for a direct-indirect lighting fixture having a light baffle in the bottom opening of the fixture is fabricated from a unitary extruded part having a baffle plate integrally interconnecting sidewall portions and a central housing structure for the lighting fixture housing. The baffle plates are provided with a suitable aperture pattern by means of a punching process.

7 Claims, 5 Drawing Sheets

UNITARY EXTRUDED HOUSING FOR DIRECT-INDIRECT LUMINAIRE

BACKGROUND OF THE INVENTION

The present invention relates to linear lighting fixtures having extruded housings, and more particularly relates to a direct-indirect linear lighting fixture having a top opening for providing indirect lighting and bottom openings for providing a direct lighting component. The type of lighting fixtures to which the invention relates will typically be used in institutional settings as well as commercial settings where the fixtures are subject to periodic cleaning and maintenance.

Extruded housings for a linear direct-indirect lighting fixture have heretofore been fabricated in separate extruded, co-linear aluminum parts held together by cross braces to provide a linear lighting fixture of a desired length. The cross braces hold the extruded elements of the housing in parallel-spaced relation such that parallel openings run the length of the housing over which elongated light screens having a desired perforation or aperture pattern can be placed to prevent the viewer from looking directly into the interior of the fixture. Typically, such screens are made in perforated sections of sheet metal or plastic typically having a length of eight feet, and are attached to adjacent co-linear housing elements by means of spring clips. Such a multi-part construction is relatively cumbersome to assemble and requires a relatively large inventory of different parts. Unsightly seams can also appear along the edges and between the ends of abutting light screens which leak light in unintended places. In addition, plastic baffles tend to discolor and disintegrate in time, and sheet metal baffles are easily dented or bent during periodic maintenance and clearing.

The present invention provides an extruded housing for a direct-indirect linear lighting fixture which reduces the number of parts associated with the housing and which simplifies the assembly and installation of the fixture. The extruded housing of the invention also increases the structural integrity of the fixture, and eliminates unsightly seams between housing parts for long fixture runs. At the same time, the housing provides a pattern of apertures for down light which can be easily cleaned, such as with an air blower, without the need for separate light screens which can be dislodged or damaged. Additionally, the invention provides for a fixture housing which eliminates parts which often have uneven surfaces and edges that can detract from the overall appearance of the fixture.

SUMMARY OF THE INVENTION

Briefly, the invention is a housing for a linear direct-indirect lighting fixture which, including the down light aperture portions of the housing, is the unitary part fabricated from a single extrusion, preferably an aluminum extrusion. The housing includes an opaque elongated sidewall portion having a top edge defining a top opening for providing indirect lighting, a corresponding elongated opaque central housing structure extending in co-linear relationship with the sidewall portion, and an elongated light baffle plate interconnecting the sidewall portion and the central housing structure. The light baffle plate of the housing has a pattern of apertures or light openings for providing a down light component from the bottom of the fixture. Preferably, the apertures of the baffle plate are provided using a punching process on an extrusion that is cut to a desired length.

The illustrated version of unitary extruded housing of the invention is symmetrical housing which includes symmetrically opposed sidewall portions and two co-linear baffle plates, one interspersed between the central housing structure and each of the sidewall portions. It is understood, however, that an asymmetrical housing can be fabricated in accordance with the invention with a single or multiple baffle plates, for example, for providing a wall-mounted fixture. Other symmetrical versions of the housing of the invention are also possible which provide for more than two co-linear baffle plates.

Therefore, a primary object of the invention is to provide an extruded housing for a direct-indirect lighting fixture that reduces manufacturing and assembly time and cost, and that is relatively easy to assemble. It is another object of the invention to reduce the number of total parts necessary to assemble a linear direct-indirect lighting fixture, and eliminate tolerance problems associated with multiple parts. It is a further object of the invention to provide a direct-indirect lighting fixture of greater structural integrity, and a direct-indirect lighting fixture having apertured portions which cannot become dislodged or which cannot be easily dented, bent or otherwise damaged. It is still another object of the invention to eliminate shadow areas produced by cross braces used in multi-part housings. Other objects of the present invention will be apparent from the following specification and claims.

DETAILED DESCRIPTION OF THE ILLUSTRATED EMBODIMENT

Figure 1:
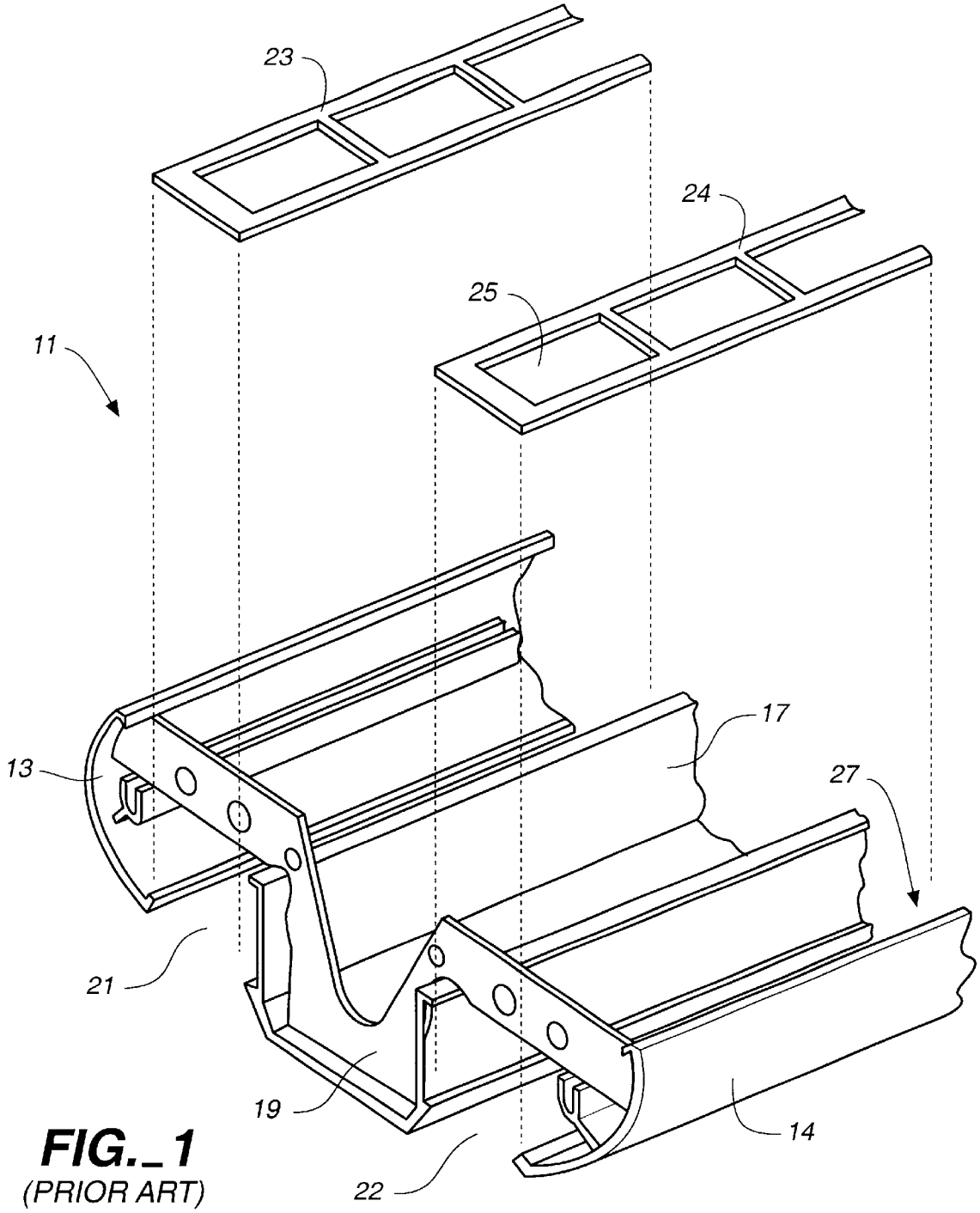
FIG. 1 (PRIOR ART)
FIG. 1 is a top fragmentary perspective view of a housing for a prior art linear direct-indirect lighting fixture.
Figure 2:
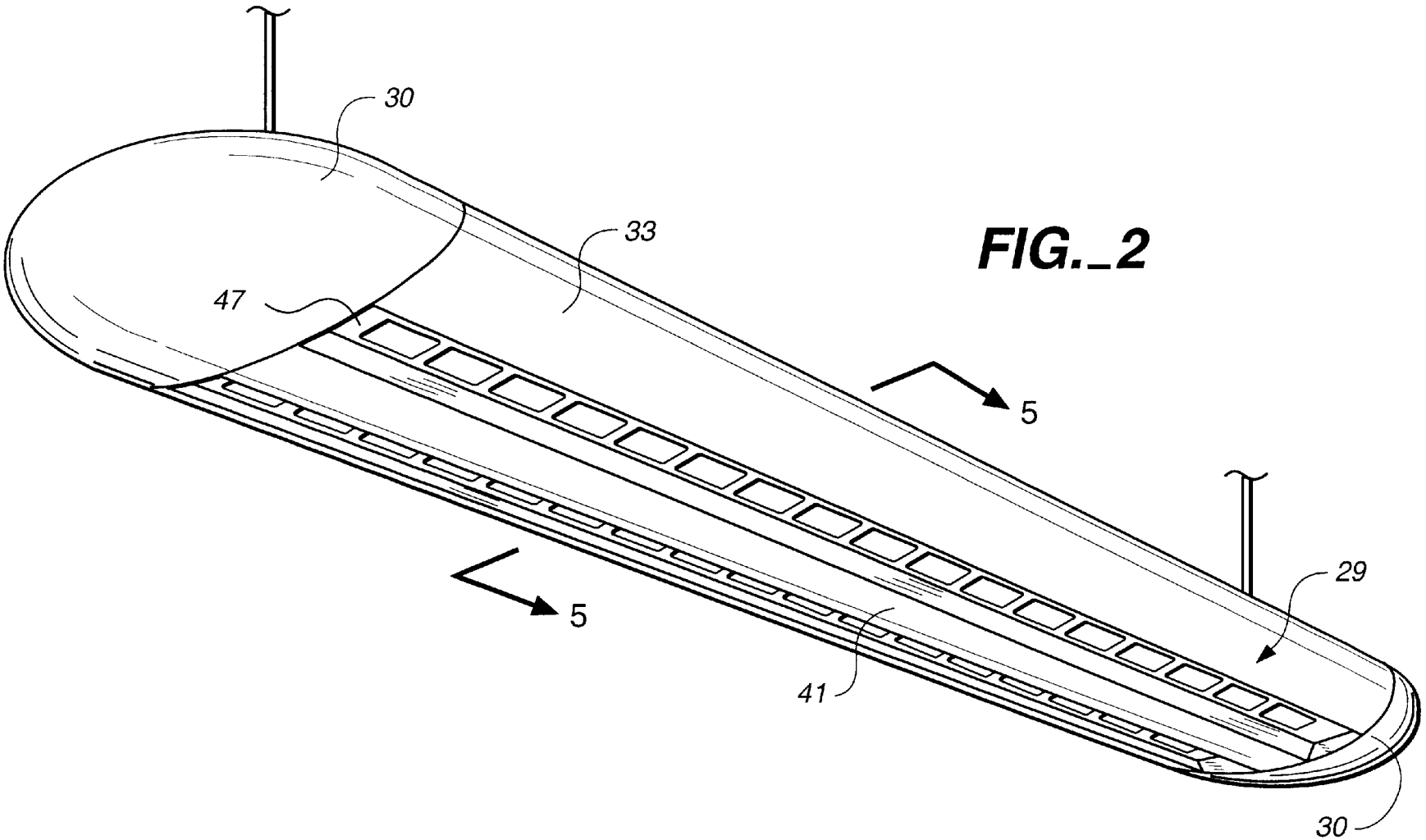
FIG. 2 is bottom perspective view of a direct-indirect lighting fixture having a unitary housing in accordance with the invention.

Referring now to the drawings, FIG. 1 illustrates a configuration of a three-part housing used in a prior art linear direct-indirect lighting fixture. It can be seen that housing 11 of this prior art fixture consists of three separate extruded aluminum elements, namely, two extruded sidewall sections 13, 14 (each of which has a reflector mount in the form of an extruded screw slot 15, 16), and a separate center trough section 17. The three extruded parts of the housing are held in place by a series of cross braces, such as cross brace 19, which are typically provided at four foot intervals over the length of the fixture. The cross braces hold the extruded parts of the housing in laterally spaced relation such that two parallel, longitudinal openings 21, 22 are provided at the bottom of the fixture housing. It is through openings 21, 22 that a direct lighting component is provided from the bottom of the fixture. To control and baffle this direct light, separate light screens 23, 24 having a desired pattern of apertures 25 are placed over the housing's bottom openings. These light screens typically are held in place by spring clips (not shown) and are conventionally fabricated of a relatively thin plastic or sheet metal material, which can become easily dislodged or bent during cleaning or maintenance. It is noted that while the down light component of the direct-indirect lighting fixture shown in FIG. 1 is provided through the apertures in the light screen elements, indirect lighting is produced through the top opening 27 of the fixture which is defined by the top edges of the separate extruded sidewall sections 13, 14.

FIGS. 2–5 show a housing for a direct-indirect lighting fixture in accordance with the invention wherein the housing and baffles are a unitary part fabricated from a single extrusion. More specifically, housing 29 includes opaque elongated sidewall portions 31, 33 having top edges 35, 37 which define top opening 39, and additionally includes elongated opaque central housing structure 41 which is generally trough-shaped and which has an extruded T-slot 43 to which a fixture ballast can be secured. Baffle plates 45, 47 interconnect the sidewall portions 31, 33 and central housing structure 41. When extruded, these baffle plates will be blank plates through which a pattern of light apertures can be provided, preferably by means of a punching operation performed on the extrusion. The punched apertures will have relatively thick aperture sidewalls as compared to apertures in a sheet metal or plastic baffle light screens as shown in FIG. 1. Such added thickness will have the advantage of providing selective surfaces that can accentuate apertures. Suitably the thickness of the baffle plates will be between approximately 3/32" and 1/8".

Sidewall portions 31, 33 are seen to be curved sidewalls that extend downward and inward and that terminate with interior longitudinal edges 34, 36. The trough-shaped central housing structure is seen to have outwardly angled interior walls 42 having outer longitudinal edges 44 opposed to the interior longitudinal edges 34, 36 of the sidewalls. The integral baffle plates 45, 47, extend the length of the housing between the opposed longitudinal edges of the sidewalls and central housing structure.

Figure 3:
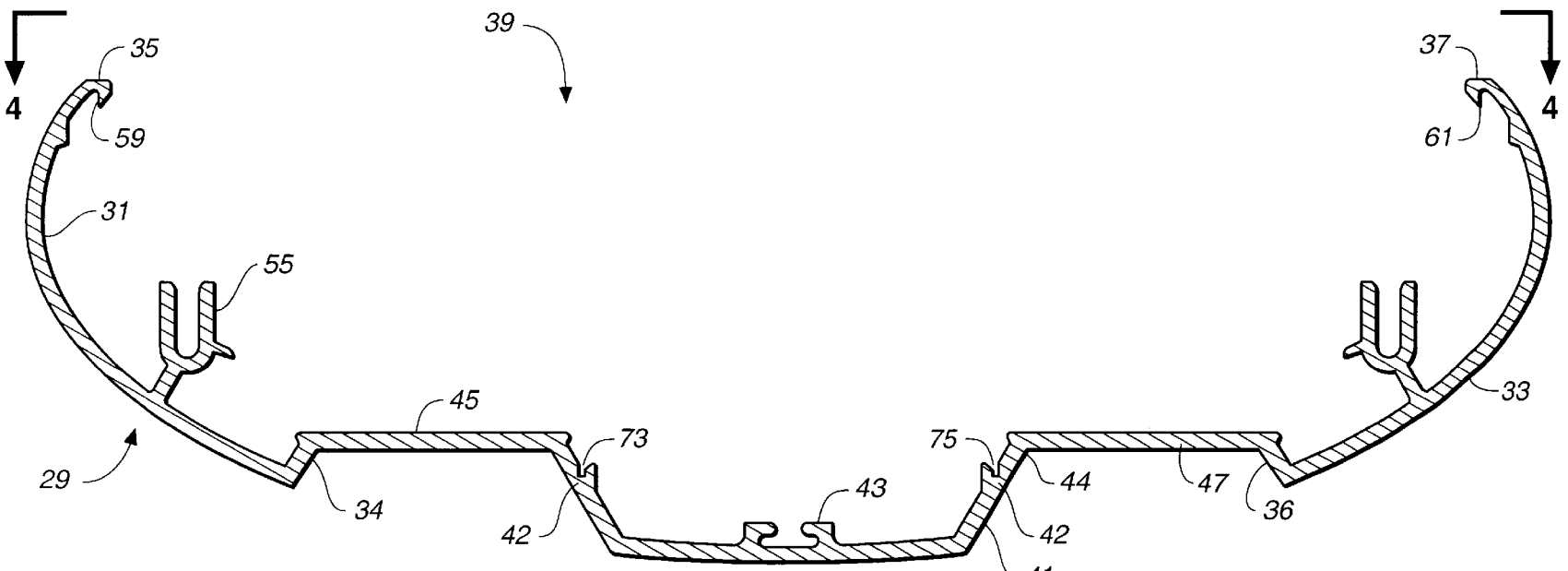
FIG. 3 is a side elevational view in cross-section of the unitary housing for the direct-indirect lighting fixture shown in FIG. 1.
Figure 4:
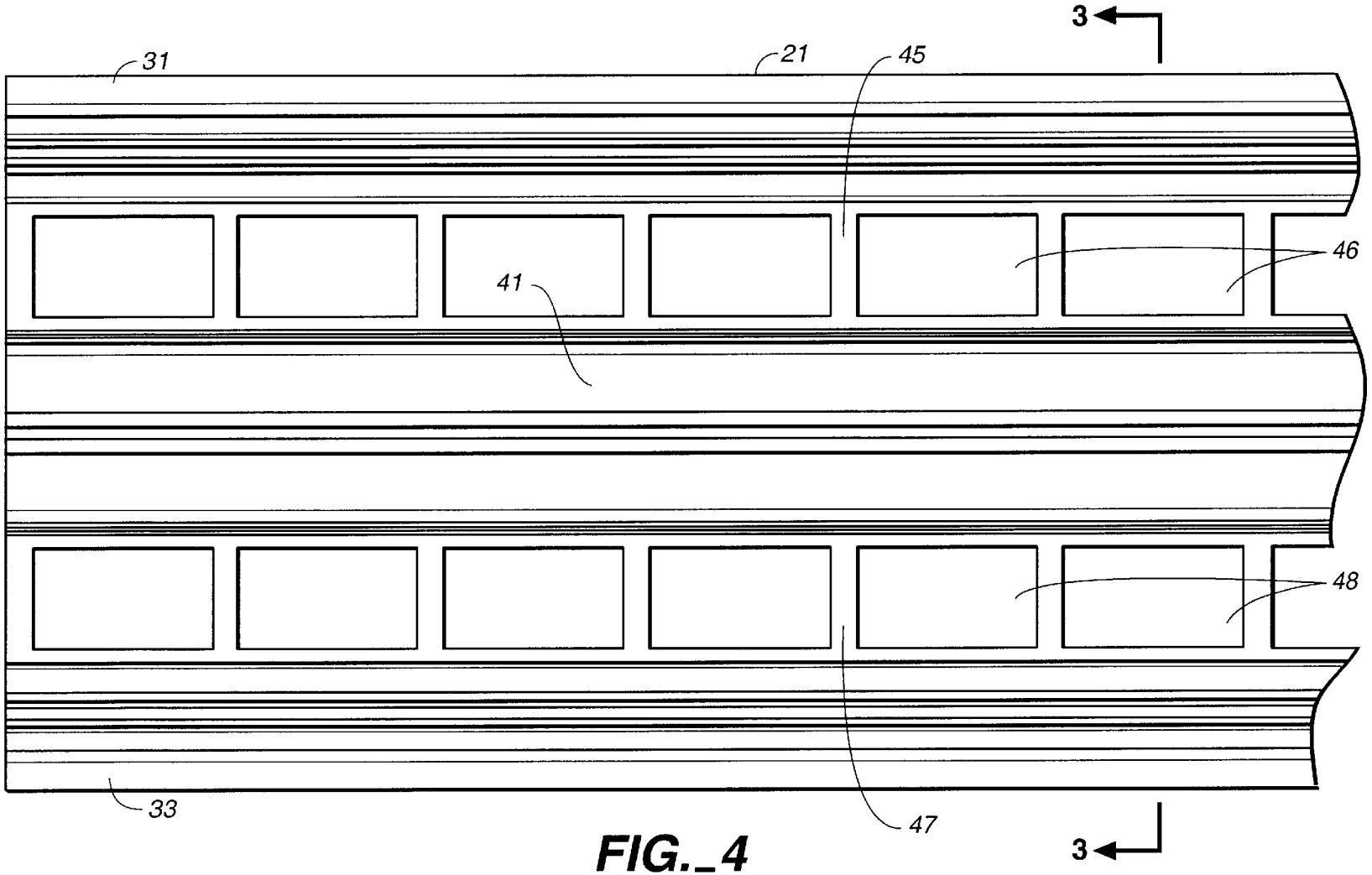
FIG. 4 is a top plan view thereof.
Figure 5:
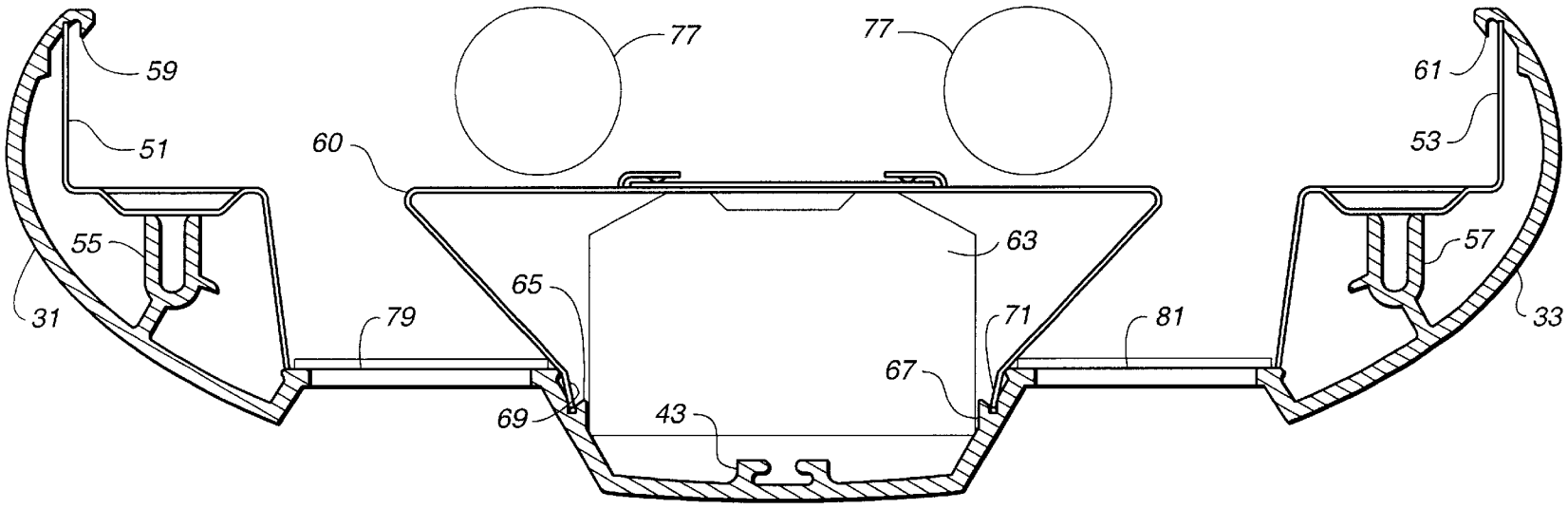
FIG. 5 is a side elevational view in cross-section of the direct-indirect lighting fixture of FIG. 1 taken along lines 5—5, illustrating the placement of a reflector system, light source and ballast in the lighting fixture housing.
Figure 6:
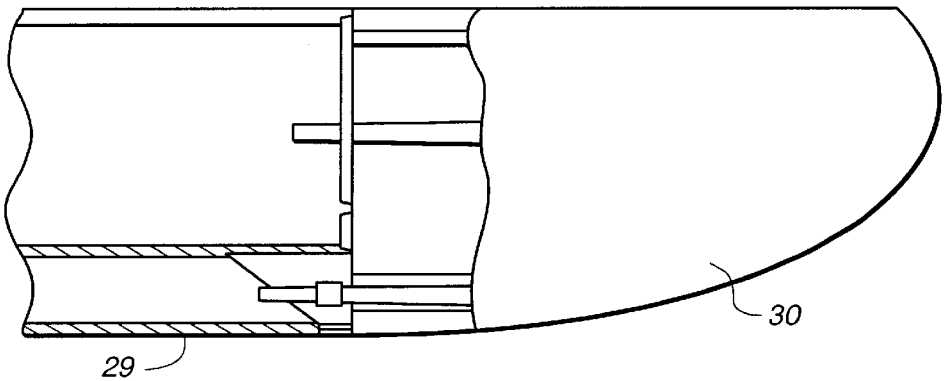
FIG. 6 is a fragmentary side elevational view in partial cross-section showing an end cap attached to the end of a housing in accordance with the invention.

FIG. 4 shows a reflector system, light source, and ballast mounted within the unitary housing 29 shown in FIG. 3. FIG. 5 shows how the end of the extruded housing can be terminated with a suitable end cap. It is understood that the end of the extruded housing could also be connected to other similar housings by means of a variety of possible connectors, such as straight connectors, elbow connectors, and T-connectors.

Referring to FIG. 4, side reflectors 51, 53 are secured to screw channels 55, 57 which are extruded into the sidewall portions 31, 33 of the unitary housing 29. The top end of reflectors 51, 53 suitably fit within retaining grooves 59, 61 formed along these top edges. Ballast 63, is positioned within the trough-shaped central housing structure between two vertical ridges 65, 67 which contain the ballast. To anchor the ballast, the ballast flanges (not shown) can be attached to screws anchored in T-slot 43. Elongated center reflector part 60 snaps into place over ballast 63 by inserting the inwardly projecting bottom ends 69, 71 of the center reflector into top reflector extruded grooves 73, 75.

The light source for the fixture is in the form of fluorescent lamps 77 which insert into lamp sockets (not shown) mounted at suitable intervals along the housing. Light produced by the fluorescent lamps is directed through the top opening 39 to produce indirect lighting, and through the pattern of apertures 46 punched in the baffle plates 45, 47 to produce a component of direct lighting. Acrylic diffuser strips 79, 81 act to diffuse the light emitted through the baffle plates.

To fabricate and assemble a linear direct-indirect lighting fixture using the unitary housing of the invention, extrusions such as shown in FIG. 3 are fabricated and cut to desired lengths, which can suitably range from four foot lengths to twenty-four foot lengths, depending on the installation requirements. Thereafter, the extrusions, when held by a suitable jig, can be run through a punching machine for punching the aperatures 46 in baffle plates 45, 47. The ballast, reflector system and light source, including light sockets and wiring, are then assembled within the housing without the need to join various housing parts together by cross braces as shown in FIG. 1.

Therefore, it can be seen that the present invention provides for a unitary extruded housing for a direct-indirect linear lighting fixture which simplifies assembly and reduces assembly cost. The unitary housing of the invention also increases the structural integrity of the fixture. While the present invention has been described in considerable detail in the foregoing specification, it is understood that the invention is not intended to be limited by such detail, except as necessitated by the following claims.

What I claim is:

1. An extruded housing for an elongated direct-indirect lighting fixture comprising an opaque elongated sidewall portion having a top edge defining a top opening for providing indirect lighting, an elongated opaque central housing structure in co-linear relation with said sidewall portion, and an elongated light baffle plate interconnecting said sidewall portion and central housing structure, said baffle plate having a pattern of apertures for providing a direct lighting component from the luminaire, said sidewall portion, central housing structure and baffle plate being a unitary part fabricated from a single extrusion.

2. The extraded housing of claim 1 wherein the openings in said baffle plate are formed by a punching process on the extruded unitary part from which the luminaire housing is fabricated.

3. The extruded housing of claim 1 wherein said sidewall portion extends downward and inwardly to form an inward longitudinal bottom edge, wherein said central housing structure has an outer longitudinal edge opposed to the inward longitudinal edge of said sidewall portion, and wherein said light baffle extends between the longitudinal edge of said sidewall portion and the longitudinal edge of said central housing structure.

4. The extruded housing of claim 1 wherein said central housing structure has a trough shape.

5. An extruded housing for an elongated direct-indirect lighting fixture comprising an opaque elongated sidewall portion having a top edge defining a top opening for providing indirect lighting, and extending downwardly and inwardly to form an inward longitudinal bottom edge, a trough elongated opaque central housing structure in co-linear relation with said sidewall portion, and having an outer longitudinal edge opposed to the inward longitudinal edge of said sidewall portion, a continuous light baffle plate extending between and interconnecting the opposed longitudinal edges of said sidewall portion and central housing structure, said elongated baffle plate having a pattern of punched apertures for providing a direct lighting component from the luminaire, said sidewall portion, central housing structure and baffle plate being an unitary part fabricated from a single extrusion.

6. An extruded housing for an elongated direct-indirect lighting fixture comprising co-linear opaque elongated sidewall portions having opposed co-linear top edges defining a top opening for providing indirect lighting, an elongated opaque central housing structure disposed between and in co-linear relation with said sidewall portions, and co-linear elongated light baffles interconnecting said sidewall portions and said central housing structure, each of said elongated light baffle having a pattern of punched apertures for providing a direct lighting component from the luminaire, said sidewall portion, central housing structure and light baffle being a unitary part fabricated from a single extrusion.

7. A method for fabricating a housing for a linear direct-indirect fighting fixture having a sidewall portion, a central housing structure, an opening for direct lighting between the sidewall portion and the central housing structure, and a light baffle element for said opening, said method comprising the steps of extruding as a single extrusion a unitary housing structure including a sidewall portion, a central housing structure, and a baffle plate interconnecting said sidewall portion and central housing structure, and punching apertures in said baffle plate to produce a desired aperture pattern therein.

* * * * *